US005896863A

United States Patent [19]

Smith

[11] Patent Number: 5,896,863

[45] Date of Patent: Apr. 27, 1999

[54] METHOD OF USING A POSEABLE HAIR STRAND SYSTEM

[76] Inventor: Loretta L. Smith, 9329 Castlewood St., Oakland, Calif. 94605

[21] Appl. No.: 08/915,482

[22] Filed: Aug. 20, 1997

[51] Int. Cl.[6] ..... A45D 8/34

[52] U.S. Cl. ..... 132/210; 132/212; 132/275

[58] Field of Search ..... 132/201, 210, 132/212, 246, 247, 273, 275, 53

[56] References Cited

U.S. PATENT DOCUMENTS

| | | | |
|---|---|---|---|
| D. 357,701 | 4/1995 | White | D19/59 |
| 1,511,743 | 10/1924 | Meserole | 132/246 |
| 1,530,854 | 3/1925 | Putt | 132/246 |
| 1,591,120 | 7/1926 | Fulton | 132/246 |
| 1,693,005 | 11/1928 | Steichen | 132/246 |
| 2,066,709 | 1/1937 | Adams | 132/246 |
| 2,517,349 | 8/1950 | Raditz | 132/53 |
| 3,955,587 | 5/1976 | Dunn et al. | 132/53 |
| 3,968,807 | 7/1976 | Kraicer | 132/53 |
| 4,658,841 | 4/1987 | Won | 132/53 |
| 5,107,867 | 4/1992 | Barrington | 132/201 |
| 5,180,325 | 1/1993 | Eddins et al. | 446/385 |
| 5,283,297 | 2/1994 | Miyachi et al. | 525/454 |
| 5,404,892 | 4/1995 | Bretl | 132/275 |

FOREIGN PATENT DOCUMENTS

| | | | |
|---|---|---|---|
| 74121 | 1/1918 | Austria | 132/275 |
| 611530 | 8/1994 | European Pat. Off. | 132/201 |
| 405302209 | 11/1993 | Japan | 132/201 |

*Primary Examiner*—Todd E. Manahan
*Attorney, Agent, or Firm*—Goldstein & Canino

[57] ABSTRACT

A poseable hair strand system for use in the creation of braids. The strands comprise at least one wire and at least one mass of hair. In the first embodiment, three wires are connected to each other. In the second embodiment, two wires are affixed to a mass of hair, the mass of hair positioned between the two wires. The third embodiment, comprises two masses of hair and one wire, wherein the wire is positioned between the masses of hair. The wires are covered with a coating that is available in a variety of colors to match typical hair colors. The wires are thin and bendable, thus allowing the wires to be easily cut and easily positioned around one's hair. The poseable hair strand system can be employed to be add structure to one's braids. It can also be used to add extensions to one's preexisting hair, thereby adding volume to the hair.

1 Claim, 2 Drawing Sheets

METHOD OF USING A POSEABLE HAIR STRAND SYSTEM

BACKGROUND OF THE INVENTION

The invention relates to poseable hair strand assemblies. In particular, the invention relates to poseable wires that are braided along with one's hair to lend structure to said braid. The invention may also be used to add synthetic hair extensions to existing hair.

Women spend a great deal of time and effort making their hair fashionable and presentable. Hair can be arranged in many different ways: it can be curled, straightened, braided, beaded, and put in a ponytail. Hair styling has emerged in the 1990's as a true art form. In fact, many women having hair of shorter lengths want to add extensions to their hair in order to create different styles.

Braiding has become a very popular hairstyle over the last decade. Braiding can lend creativity to one's appearance and allows the style to changed frequently. Although braiding is a preferred form of hairstyle, the texture and thickness of many women's hair often gives them problems. Thin or unevenly cut hair will tend to unravel from the braid. Hair extensions can also cause problems since it is difficult to add the extension by way of a braid without showing the use of said extensions. Because of the difficulty of braiding one's hair, many women seek professional help to create different styles involving braids.

U.S. Pat. No. 5,180,325 to Eddins et al. discloses a poseable hair strand for a toy doll comprising thin flexible fibers that are intertwined into the hair of a doll. While this invention discloses strands that can aid in the styling of a doll's hair, it is impractical to use such a device on human hair.

U.S. Pat. No. Des. 357,701 to White discloses the design for a combined doll and stand for teaching hair braiding.

While these units may be suitable for the particular purpose employed, or for general use, they would not be as suitable for the purposes of the present invention as disclosed hereafter.

SUMMARY OF THE INVENTION

It is an object of the invention to produce poseable hair strand assemblies. More particularly, the invention comprises poseable wires that aid in the creation of braids.

It is a further object of the invention to produce poseable hair strand assemblies that are composed of thin bendable wires surrounded by a coating that is available in different colors in order to match one's hair color. The coating will blend into one's hair, thereby not being detectable.

It is a further object of the invention to produce poseable hair strand assemblies that can be used in human hair or in synthetic hair. In human hair, the strands can be used to add structure and body to a braid. In synthetic hair, the strands can be used to add extensions to one's existing hair, as well as making the task of braiding easier.

It is a still further object of the invention to produce poseable hair strand assemblies that can easily be cut according to the length of the braid. In addition, the strands are poseable in order to allow the user to bend the strand to create the desire style.

It is a still further object of the invention to produce poseable hair strand assemblies that are available in three different styles, namely single wire, double wire and triple wire. According to the texture of one's hair and the style of braid desired, the different style of strand most suited to the situation may be employed.

The invention is a poseable hair strand system for use in the creation of braids. The strands comprise at least one wire and at least one mass of hair. In the first embodiment, three wires are connected to each other. In the second embodiment, two wires are affixed to a mass of hair, the mass of hair positioned between the two wires. The third embodiment, comprises two masses of hair and one wire, wherein the wire is positioned between the masses of hair. The wires are covered with a coating that is available in a variety of colors to match typical hair colors. The wires are thin and bendable, thus allowing the wires to be easily cut and easily positioned around one's hair. The poseable hair strand system can be employed to be add structure to one's braids. It can also be used to add extensions to one's preexisting hair, thereby adding volume to the hair.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
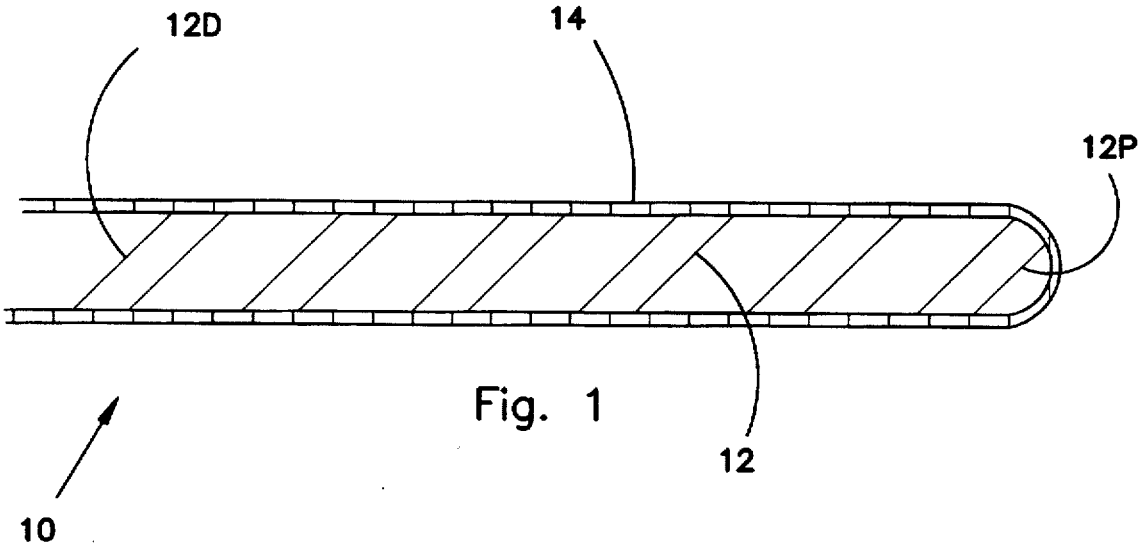
FIG. 1 is a cross sectional view of a bendable wire of a poseable hair strand assembly.

FIG. 1 illustrates a cross sectional view of a bendable wire 12 of a poseable hair strand assembly 10. The bendable wire 12 has a proximal end 12P and a distal end 12D, and a coating 14.

The coating 14 surrounds the bendable wire 12, thereby disguising the wire 12 from view. The coating 14 can be made available in a variety of colors that match typical hair colors, such as black, brown, blonde or red.

The bendable wire 12 of the poseable hair strand assembly 10 is thin and therefore infinitely shapeable. Further, the bendable wire 12 can easily be cut as necessary. The flexibility of the bendable wire 12 allows a user to create different styles other than a traditional braid.

Figure 2A:
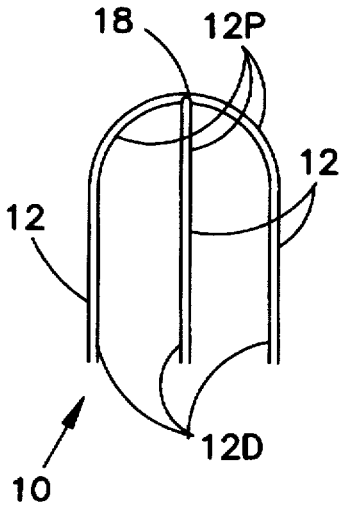
FIG. 2*a* is a perspective view of a first embodiment of a poseable hair strand assembly depicting a triple bendable wire.

The invention anticipates at least three different embodiments. A first embodiment, as illustrated in FIG. 2*a*, comprises a poseable hair strand assembly 10 having three bendable wires 12. The three bendable wires 12 are all connected to each other, by means of an adhesive material, at their proximal ends 12P, thus forming a common point of connection 18. The adhesive material should be sufficiently strong so as to bind the three segments together, however, it should not stick to existing hair on one's head. The three bendable wires 12 are positioned adjacent to each other.

Figure 2B:
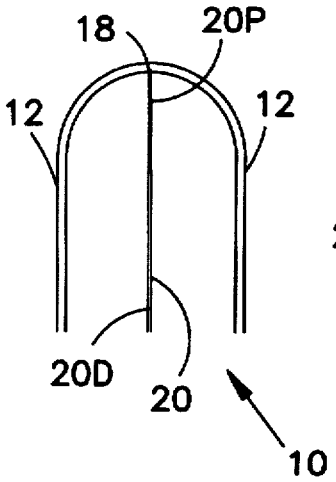
FIG. 2*b* is a perspective view of a second embodiment of a poseable hair strand assembly depicting a double bendable wire having a mass of hair attached in between the two wires.

FIG. 2*b* illustrates a second embodiment of the poseable hair strand assembly 10 having two bendable wires 12 and a mass of hair 20. The mass of hair 20 has a proximal end 20P and a distal end 20D. As in the first embodiment, the three segments are affixed to each other by means of an adhesive material at a common point of connection 18. The mass of hair 20 is positioned in between the two bendable wires 12 and the three segments are arranged adjacent to each other.

Figure 2C:
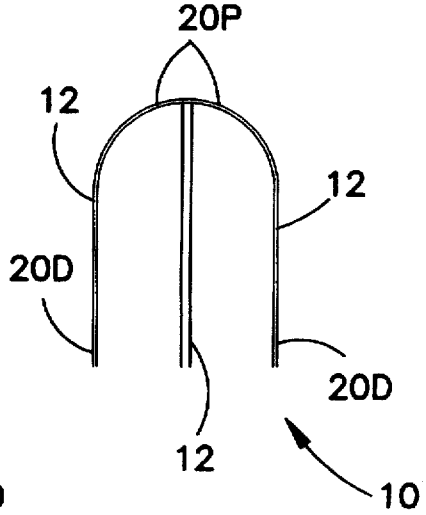
FIG. 2*c* is a perspective view of a third embodiment of a poseable hair strand assembly depicting a single bendable wire having two masses of hair attached on opposite sides of the wire.

FIG. 2*c* illustrates a third embodiment having one bendable wire 12 and two distinct masses of hair 20. Again, the three segments are joined at a common point of connection 18 by an adhesive material, the bendable wire 12 positioned in between the two hair masses 20. All three are arranged adjacent to each other.

Figure 3:
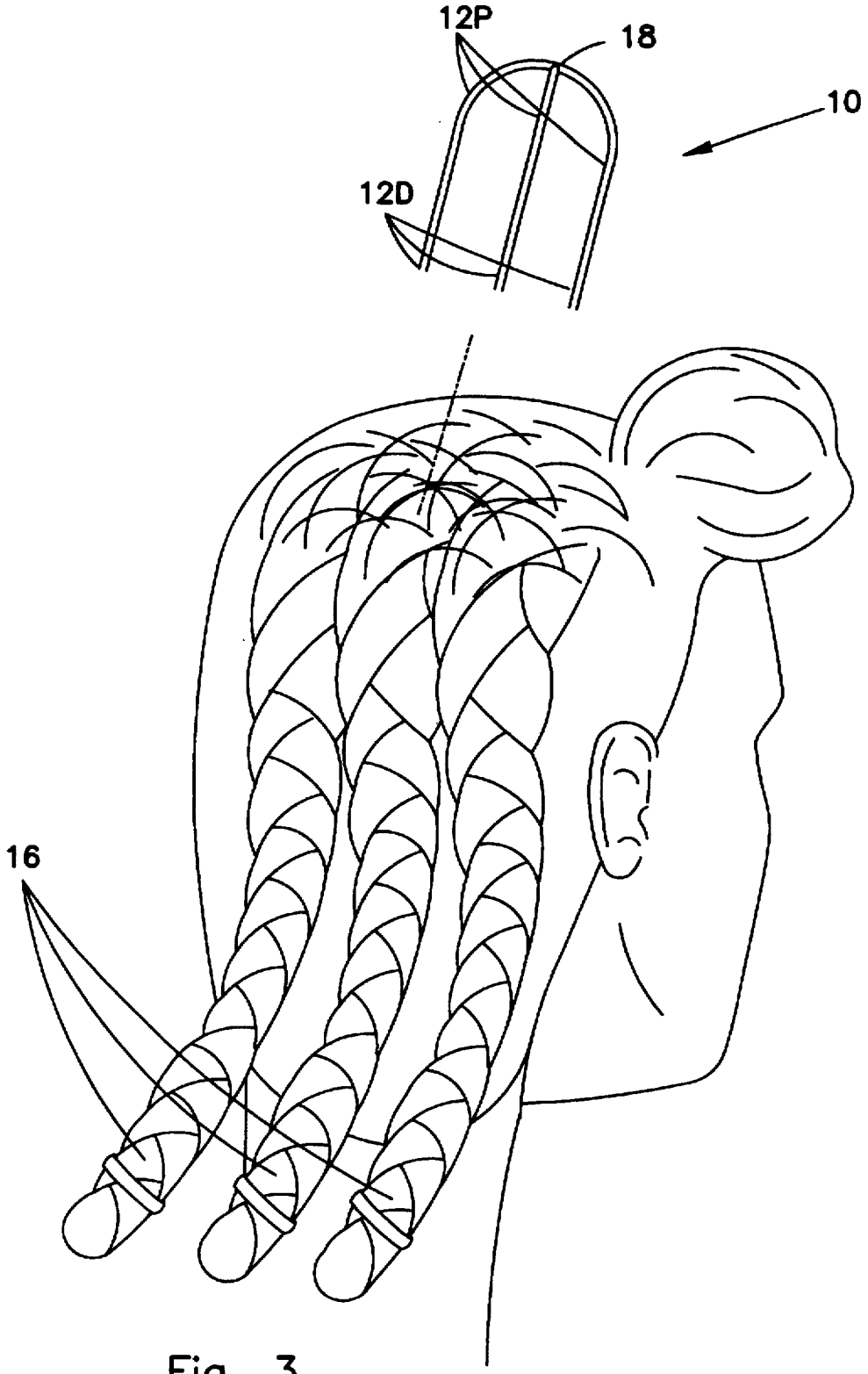
FIG. 3 is a perspective view of the first embodiment of a poseable hair strand assembly depicting a triple bendable wire being inserted in one's hair that has been styled into braids.

FIG. 3 illustrates the employment of the first embodiment of the poseable hair strand assembly 10. The distal ends 12D of the three bendable wires 12 are inserted into preexisting braids 16. The poseable hair strand assemblies 10 are pushed down into the braid until the entirety of the strands run along the length of the braid 16. Once the strands 10 are in place, the common point of connection 18 of the bendable wires 12 should be positioned at the top of the head, thus the beginning of the braids 16. If the correct color of the coating 14 has been chosen, the coating 14 over the bendable wire 12 would blend into one's hair and therefore not be detectable.

The second and third embodiments, illustrated in FIGS. 2*b* and 2*c*, are typically utilized when adding hair extensions to one's existing hair. These poseable hair strand assemblies 10 add volume to one's hair as well as enabling one to create different hair styles. The bendable wires 12 are flexible, thereby allowing a user to bend the strands as the particular style dictates.

What is claimed is:

1. A method of using a poseable hair strand assembly in existing hair, said assembly having three segments including at least one bendable wire but not more than three and two or less masses of hair, each bendable wire covered with a coating, wherein three segments are affixed to each other at one end thereof at a common point of connection, comprising the steps of:

a) choosing the combination of bendable wires and mass of hair best suited to the existing hair;

b) choosing the color of the coating that most closely matches the color of the existing hair;

c) intertwining the poseable hair strand assembly with the existing hair to form a braid; and d) cutting any excess wire that extends below the braid.

* * * * *